US011225964B2

(12) United States Patent
Fabry et al.

(10) Patent No.: US 11,225,964 B2
(45) Date of Patent: Jan. 18, 2022

(54) CYLINDRICAL SYMMETRIC VOLUMETRIC MACHINE

(71) Applicant: ATLAS COPCO AIRPOWER, NAAMLOZE VENNOOTSCHAP, Wilrijk (BE)

(72) Inventors: Erik Paul Fabry, Wilrijk (BE); Anton Jan Goethals, Wilrijk (BE); Bart Maria M. Raes, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 122 days.

(21) Appl. No.: 16/616,612

(22) PCT Filed: Jun. 5, 2018

(86) PCT No.: PCT/IB2018/054004
§ 371 (c)(1),
(2) Date: Nov. 25, 2019

(87) PCT Pub. No.: WO2019/002994
PCT Pub. Date: Jan. 3, 2019

(65) Prior Publication Data

US 2020/0088192 A1 Mar. 19, 2020

(30) Foreign Application Priority Data

Jun. 28, 2017 (BE) ..... 2017/5459

(51) Int. Cl.

| | |
|---|---|
| ***F03C 2/00*** | (2006.01) |
| ***F03C 4/00*** | (2006.01) |
| ***F04C 18/00*** | (2006.01) |
| ***F04C 2/00*** | (2006.01) |

(Continued)

(52) U.S. Cl.
CPC ..... *F04C 2/107* (2013.01); *F04C 2/1076* (2013.01); *F04C 11/008* (2013.01); *F04C 15/0069* (2013.01); *F04C 2240/40* (2013.01)

(58) Field of Classification Search
CPC ..... F04C 2/102; F04C 2/107; F04C 2/1076; F04C 11/008; F04C 15/006; F04C 15/0069; F04D 13/06
See application file for complete search history.

(56) References Cited

U.S. PATENT DOCUMENTS 2,765,114 A 10/1956 Chang
4,127,365 A * 11/1978 Martin ..... F04C 15/0069 417/420

(Continued)

FOREIGN PATENT DOCUMENTS

WO WO-2015124918 A1 * 8/2015 ..... F04C 29/005

OTHER PUBLICATIONS

International Search Report for PCT/IB2018/054004 dated Sep. 18, 2018 [PCT/ISA/210].

(Continued)

*Primary Examiner* — Theresa Trieu
(74) *Attorney, Agent, or Firm* — Sughrue Mion, PLLC

(57) ABSTRACT

Cylindrical symmetric volumetric machine (1), which machine (1) includes two cooperating rotors (6*a*, 6*b*), namely an outer rotor (6*a*) which is rotatably mounted in the machine (1) and an inner rotor (6*b*) which is rotatably mounted in the outer rotor (6*a*), whereby the machine (1) is provided with an electric motor (15) with a motor rotor (16) and a motor stator (17) to drive the outer and inner rotor (6*a*, 6*b*), characterised in that the electric motor (15) is mounted around the outer rotor (6*a*), whereby the motor stator (17) is directly driving the outer rotor (6*a*), and whereby the electric motor (15) extends along only a part of the length (L) of the (Continued)

outer rotor (6*a*) and the inner rotor (6*b*), whereby the motor (15) is located at an end (9*b*) of the inner rotor (6*b*) with a smallest diameter (D).

15 Claims, 1 Drawing Sheet

(51) Int. Cl.

| | |
|---|---|
| ***F04C 2/107*** | (2006.01) |
| ***F04C 15/00*** | (2006.01) |
| ***F04C 11/00*** | (2006.01) |

(56) References Cited

U.S. PATENT DOCUMENTS

| | | | | |
|---|---|---|---|---|
| 4,802,827 | A * | 2/1989 | Fujiwara | F04D 3/02 417/356 |
| 4,863,357 | A * | 9/1989 | Olofsson | F01C 2/107 418/48 |
| 6,361,292 | B1 | 3/2002 | Chang et al. | |
| 2005/0265860 | A1* | 12/2005 | Kameya | F04C 2/00 417/410.4 |
| 2010/0092317 | A1* | 4/2010 | Suhara | F04C 2/1071 418/48 |
| 2012/0164009 | A1* | 6/2012 | Sakata | F04C 2/00 417/410.4 |

OTHER PUBLICATIONS

Written Opinion for PCT/IB2018/054004 dated Sep. 18, 2018 [PCT/ISA/237].

International Preliminary Report on Patentability for PCT/IB2018/054004 dated Sep. 18, 2019 [PCT/IPEA/409].

* cited by examiner

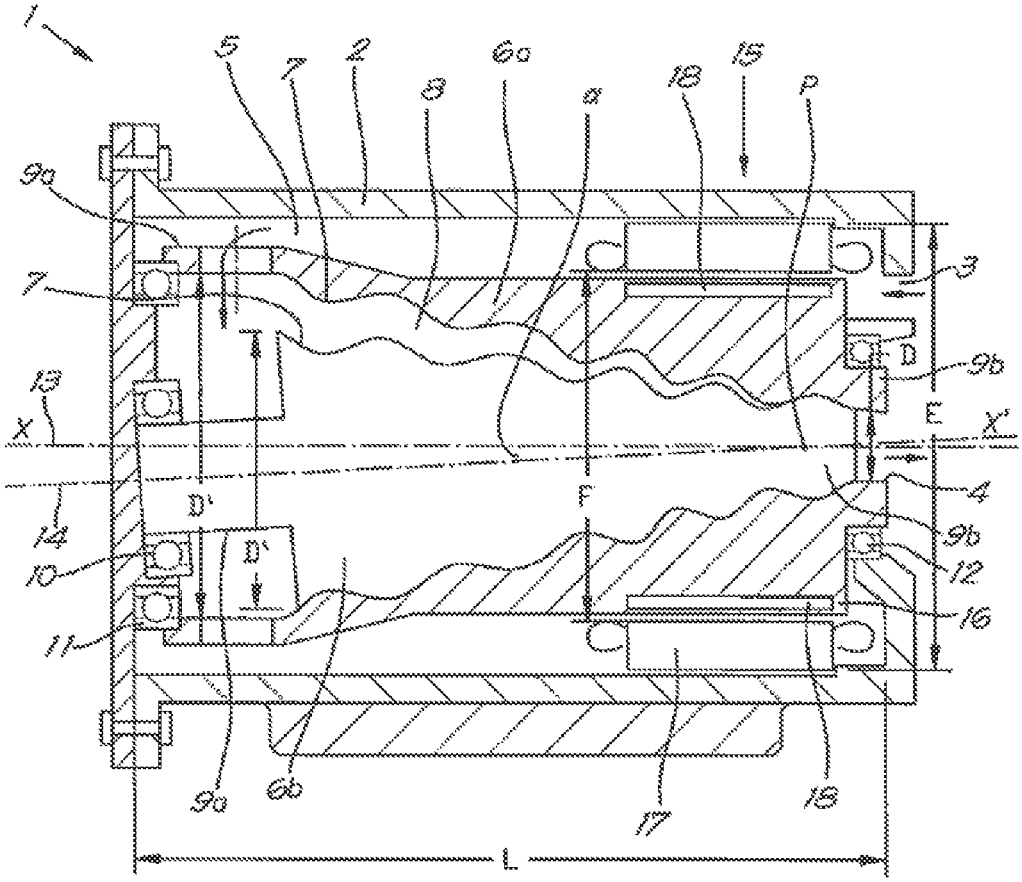
1
5
7
2
8
6a
a
18
15
P
9a
7
3
D
9b
13
X
E
X'
4
14
D'
F
9b
10
D'
12
16
11
9a
6b
17
18
L

CYLINDRICAL SYMMETRIC VOLUMETRIC MACHINE

CROSS REFERENCE TO RELATED APPLICATIONS

This application is a National Stage of International Application No. PCT/IB2018/054004 filed Jun. 5, 2018, claiming priority based on Belgium Patent Application No. 2017/5459 filed Jun. 28, 2017.

BACKGROUND

A. Field

The present invention is related to a cylindrical symmetric volumetric machine.

B. Description of Related Art

A volumetric machine is also known under the (English) name: "positive displacement machine".

More specifically, the invention is related to machines such as expanders, compressors, and pumps with a cylindrical symmetry comprising two rotors, namely an inner rotor which is rotatably mounted into an outer rotor.

Such machines are already known and are described, for example, in U.S. Pat. No. 1,892,217. It is also known that the rotors may have a cylindrical or conical shape.

It is known that such machines may be driven by an electric motor.

Hereby, a rotor shaft of a motor rotor will drive a rotor shaft of the inner or outer rotor, whereby use is made of gears, couplings, belt drives, or similar to realise a transmission between both rotor shafts.

Such machines are very voluminous and consist of many parts of the motor, compressor, or expander rotors and associated housings.

As a consequence, the 'foot print' or space consumption of the machine is relatively large.

The machine will also be relatively expensive, due to the many parts and due to a resultingly more expensive assembly.

Another disadvantage is the need for a lot of shaft seals and bearings in order to seal all parts and to mount these parts rotatably into the housings.

The seals pose a risk if they would fail, while the bearings entail losses.

SUMMARY

The purpose of the present invention is to provide a solution to one or more of the foregoing and/or other disadvantages.

The present invention concerns a cylindrical symmetric volumetric machine, which machine comprises two cooperating rotors, namely an outer rotor which is rotatably mounted in the machine and an inner rotor which is rotatably mounted in the outer rotor, whereby the machine is provided with an electric motor with a motor rotor and a motor stator to drive the outer and inner rotor, with the characteristic that the electric motor is mounted around the outer rotor, whereby the motor stator is directly driving the outer rotor, and whereby the electric motor extends along only a part of the length of the outer rotor and the inner rotor, whereby the motor is located at an end of the inner rotor with a smallest diameter.

An advantage is that there is no need for a transmission between the outer rotor and the motor stator or motor rotor, as the motor stator is directly driving the outer rotor, such that less parts are needed.

Another advantage is that, due to mounting of the electric motor around the outer rotor, the foot print of the machine may be diminished, and the machine is made smaller and more compact.

Furthermore, less shaft seals are needed, which increases the reliability of the machine.

In addition, less bearings are needed, which results in less losses and, consequently, a more efficient machine.

In a practical embodiment, the motor rotor and the outer rotor are arranged as a whole or form a whole.

The motor rotor and the outer rotor may, for example, be directly joined together by means of a press fitting, by welding, or similar.

This embodiment has as advantage that a standard outer rotor may be used.

In another practical embodiment, the outer rotor serves as motor rotor.

This will ensure that the machine may be made even more compact, as if a number of parts will not be present anymore, as functions of parts or components are combined, i.e. certain parts are shared.

BRIEF DESCRIPTION OF THE DRAWING

With the intention of better showing the characteristics of the invention, some preferred embodiments of a cylindrical symmetric volumetric machine according to the invention are described hereinafter by way of example, without any limiting nature, with reference to the accompanying drawings, wherein:

FIG. 1 schematically shows a machine according to the invention.

DETAILED DESCRIPTION

The schematically shown machine 1 in FIG. 1 is in this case a compressor device.

It is according to the invention also possible that the machine 1 is an expander device. The invention may relate to a pump device as well.

The machine 1 is a cylindrical symmetric volumetric machine 1, also called "cylindrical symmetric positive displacement machine". This means that the machine 1 exhibits a cylindrical symmetry, i.e. the same symmetric properties as a cone.

The machine 1 comprises a housing 2 which is provided with an inlet 3 for the suction of gas to be compressed and an outlet 4 for compressed gas. The housing 2 defines a chamber 5.

In the housing 2 of the machine 1, two cooperating rotors 6*a*, 6*b* are located in this chamber 5, namely an outer rotor 6*a* which is rotatably mounted into the housing 2 and an inner rotor 6*b* which is rotatably mounted into the outer rotor 6*a*.

Both rotors 6*a*, 6*b* are provided with lobes 7 and are able to turn onto each other in a cooperative way, whereby between the lobes 7 a compression chamber 8 emerges whose volume is reduced by rotation of the rotors 6*a*, 6*b*, such that the gas which is caught in this compression chamber 8 is compressed. The principle is very similar to known tangent cooperative screw rotors.

The rotors 6*a*, 6*b* are mounted by means of bearings into the machine 1, whereby the inner rotor 6*b* is mounted at one end 9*a* into the machine 1. In this case, only one bearing 10 is applied to mount the inner rotor 6*b* into the housing 2 of the machine 1. This bearing 10 is an axial bearing to bear axial force that is exerted on the inner rotor 6*b*. This axial force will be directed to the left.

The other end 9*b* of the inner rotor 6*b* is, as it were, supported or borne by the outer rotor 6*a*.

The outer rotor 6*a* is in the shown example at both ends 9*a*, 9*b* mounted by means of bearings in the machine 1. Hereby, use is made of at least one axial bearing 12. This will be able to bear the axial forces to which the outer rotor 6*a* is exposed. The other bearing 11 by which the outer rotor 6*a* is mounted into the housing 2, may be another type of bearing than an axial bearing.

Due to this simple bearing arrangement, losses with respect to the bearings 10, 11, 12 may be kept as small as possible.

In the shown example, the rotors 6*a*, 6*b* have a conical shape, whereby the diameter D, D' of the rotors 6*a*, 6*b* decreases in an axial direction X-X'. This is not a necessary condition for the invention; the diameter D, D' of the rotors 6*a*, 6*b* may also be a constant or vary in another way in the axial direction X-X'.

Such shape of the rotors 6*a*, 6*b* is appropriate both for a compressor as an expander device. The rotors 6*a*, 6*b* may alternatively also have a cylindrical shape with a constant diameter D, D'. These may then have either a variable pitch such that there is an incorporated volume ratio, in the case of a compressor or expander device, or a constant pitch, in the case the machine 1 is a pump device.

An axis 13 of the outer rotor 6*a* and an axis 14 of the inner rotor 6*b* are not parallel, but are positioned under an angle α, whereby these axes 13, 14 cross each other in a point P.

This is not a necessary condition for the invention. For example, if the rotors 6*a*, 6*b* have a constant diameter D, D', the axes 13, 14 may indeed be parallel.

Although the axes 13, 14 are positioned under an angle α, these are fixed axes 13, 14. This means that, during the rotation of the rotors 6*a*, 6*b*, the axes 13, 14 will not be displaced or moving with respect to the housing 2 of the machine 1. The axes 13, 14 will, in other words, not perform an orbiting movement.

This has as advantage that no additional provisions need to be made, such as special gears to ensure a correct relative movement between both rotors 3*a*, 3*b*.

Furthermore, the machine 1 is also provided with an electric motor 15 which will drive the rotors 6*a*, 6*b*. This motor 15 is provided with a motor rotor 16 and a motor stator 17.

According to the invention, the electric motor 15 is mounted around the outer rotor 6*a*, whereby the motor stator 17 is directly driving the outer rotor 6*a*.

In the example shown, this is realised as the outer rotor 6*a* is serving as motor rotor 16 as well.

In other words: one part of the machine 1 will perform two functions, namely the function of outer rotor 6*a* and the function of motor rotor 16.

In this way, the motor stator 17 will directly drive the outer rotor 6*a*.

This has as a consequence that the machine 1 will comprise less parts, such that the machine 1 will be more compact and less complex.

As the motor stator 17 of the electric motor 15 is typically generating a cylindrical symmetric rotating field to drive the motor rotor 16, this motor rotor 16, and thus in this case also the outer rotor 6*a*, needs to exhibit a cylindrical symmetry.

As the outer rotor 6*a* is taking over the function of the motor rotor 16, the motor 15 does not add any additional rotating parts to the machine 1. For this reason, there are therefore also no additional bearings and similar with associated losses.

The magnets 18 of the electric motor 15 are in this case preferably embedded in the outer rotor 6*a*. These magnets 18 may be permanent magnets. It is of course also possible that these magnets 18 are not embedded in the outer rotor 6*a*, but are for example mounted onto an outer side thereof.

Instead of an electric motor 15 with permanent magnets (i.e. a synchronous permanent magnet motor), an asynchronous induction motor may also be applied, whereby the magnets 18 are replaced by a squirrel cage armature. By means of induction from the motor stator 17, a current is induced in the squirrel cage armature.

On the other side, the motor 15 may also be of the reluctance type or induction type or a combination of types.

As can be seen in the FIGURE, the electric motor 15 extends along only a part of a length L of the rotors 6*a*, 6*b*, whereby the motor 15 is located at an end 9*b* with a smallest diameter D.

This means that the magnets 18 are located at the end 9*b* of the rotors 6*a*, 6*b* with a smaller diameter D. It is of course also possible that the magnets 18 and the motor 15 are located at the other, larger end with a diameter D'.

This will entail even an additional space saving, such that the machine 1 becomes even more compact.

In order to make the machine 1 as compact as possible, a maximal diameter E of the motor 15 is preferably maximally twice, preferably maximally 1.7 times, and more preferably maximally 1.5 times the maximal diameter D' of the outer rotor 6*a*.

The invention is however not limited to these aforementioned dimensions. Alternatively, the maximal diameter D' of the outer rotor 6*a* may, for example, be larger than an inner diameter F of the motor stator 17. In order to make machine 1 even more compact, the maximal diameter D' of the outer rotor 6*a* may be larger than the maximal diameter E of the motor 15, i.e. the outer diameter of the motor stator 17. If the outer rotor 6*a* is made by means of injection moulding, the magnets 18 are preferably co-moulded in the outer rotor 6*a* during the injection moulding process.

It is, amongst others, due to this feature in combination with the fact that the motor 15 is located at the end 9*b* of the rotors 6*a*, 6*b* with the smallest diameter D, that the maximal diameter E of the motor 15 may be kept so small. The smaller the maximal diameter E of the motor 15, the more compact the final machine 1 and the smaller the foot print of the machine 1.

Of course, it is not excluded that other parts of the machine 1, such as for example the inner rotor 6*b*, are made by means of injection moulding as well.

The motor stator 17 is mounted around the outer rotor 6*a* in an enveloping manner, whereby the former is in this case located in the housing 2 of the machine 1.

By mounting the motor 15 into the housing 2 of the machine 1, no special motor housing needs to be provided and the machine 1 may be arranged more compactly. Moreover, there is also no need for seals between the motor 15 and the rotors 6*a*, 6*b*.

Moreover, in this way, the lubrication of the motor 15 and the rotors 6*a*, 6*b* may be controlled together, as they are located in the same housing 2, and consequently are not isolated from each other.

It is of course also possible that the housing 2 is arranged in such a way that it may also serve as housing 2 of the motor 15, or that a separate housing 2 is provided for the motor 15 which may be attached to the housing 2 of the rotors 6*a*, 6*b*.

Although in the shown example the outer rotor 6*a* of the machine 1 serves as the motor rotor 16, it is also possible that the motor rotor 16 and the outer rotor 6*a* are arranged as a whole or that they form a whole, for example as they are directly joined together by means of a press fitting, by welding, or similar.

The operation of the machine 1 is very simple and as follows.

During the operation of the machine 1, the motor stator 17 will drive the motor rotor 16 in the known way.

As in this case the outer rotor 6*a* serves as the motor rotor 16, it will thus be driven.

The outer rotor 6*a* will drive the inner rotor 6*b* with it, in the same way as a known oil-injected screw compressor with a male and a female screw rotor, whereby for example the male screw rotor is driven by a motor 15.

Due to the rotation of the rotors 6*a*, 6*b*, gas will be sucked in from the inlet 3, which will end up in a compression chamber 8 between the rotors 6*a*, 6*b*. When the gas is sucked in from the inlet 3, it will flow along the motor rotor 16 and the motor stator 17 according to the arrows P in FIG. 1, and in this way ensure the cooling of the motor 16.

By means of the rotation, the compression chamber 8 is displaced towards the outlet 4, and will at the same time decrease in volume in order to ensure a compression of the gas in this way.

The compressed gas may then leave the machine 1 through the outlet 4.

During the operation, liquid will be injected into the machine 1, to cool and/or lubricate the parts. These parts are, amongst others, the bearings 10, 11, 12, the inner and outer rotors 6*a*, 6*b*, the windings of the motor stator 17, . . . .

Hereto, the machine 1 is provided with a liquid injection circuit, not shown in the FIGURE. This liquid may, for example, be oil, whether or not a synthetic oil.

Hereby, liquid will also be injected in the chamber 5, which will ensure lubrication and sealing between the inner and outer rotor 6*a*, 6*b*.

Through the outlet 4, this liquid will leave the machine 1, together with the compressed gas. The liquid may be separated from the gas by means of a separator, and be recovered.

It is of course also possible that the machine 1 is liquid-free, and that the lubrication is done by means of fat instead of oil.

The present invention is by no means limited to the embodiments described as an example and shown in the FIGURE, but a cylindrical symmetric volumetric machine according to the invention may be realised in all kinds of forms and dimensions, without departing from the scope of the invention.

The invention claimed is:

1. A cylindrical symmetric volumetric machine (1), comprising: two cooperating rotors (6*a*, 6*b*), including an outer rotor (6*a*) which is rotatably mounted in the cylindrical symmetric volumetric machine (1) and an inner rotor (6*b*) which is rotatably mounted in the outer rotor (6*a*), whereby the cylindrical symmetric volumetric machine (1) is provided with an electric motor (15) with a motor rotor (16) and a motor stator (17) to drive the outer and inner rotor (6*a*, 6*b*), characterised in that the electric motor (15) is mounted around the outer rotor (6*a*), whereby the motor stator (17) is configured to directly drive the outer rotor (6*a*), whereby the electric motor (15) extends along only a part of a length (L) of the outer rotor (6*a*) and the inner rotor (6*b*), whereby the motor (15) is located at an end (9*b*) of the inner rotor (6*b*) with a smallest diameter (D), and whereby the outer rotor (6*a*) and the inner rotor (6*b*) have a conical shape.

2. The cylindrical symmetric volumetric machine according to claim 1, characterised in that the motor rotor (16) and the outer rotor (6*a*) are directly joined together.

3. The cylindrical symmetric volumetric machine according to claim 1, characterised in that the outer rotor (6*a*) serves as the motor rotor (16).

4. The cylindrical symmetric volumetric machine according to claim 3, characterised in that the electric motor (15) is provided with permanent magnets (18), which are embedded in the outer rotor (6*a*).

5. The cylindrical symmetric volumetric machine according to claim 4, characterised in that the magnets (18) are co-moulded in the outer rotor (6*a*) during the injection moulding process.

6. The cylindrical symmetric volumetric machine according to claim 1, characterised in that the inner rotor (6*b*) and the outer rotor (6*a*) have axes (13, 14) which are positioned under an angle ($\alpha$) with respect to each another, whereby these axes (13, 14) are crossing each other.

7. The cylindrical symmetric volumetric machine according to claim 6, characterised in that the axes (13, 14) of the inner rotor (6*b*) and the outer rotor (6*a*) are fixed, non-orbiting axes.

8. The cylindrical symmetric volumetric machine according to claim 1, characterised in that the inner rotor (6*b*) is mounted at one end (9*a*) into the cylindrical symmetric volumetric machine (1) by means of bearings.

9. The cylindrical symmetric volumetric machine according to claim 1, characterised in that the outer rotor (6*a*) is mounted into the cylindrical symmetric volumetric machine (1) by means of at least one axial bearing (11).

10. The cylindrical symmetric volumetric machine according to claim 1, characterised in that the cylindrical symmetric volumetric machine (1) is an expander, compressor, or pump device.

11. The cylindrical symmetric volumetric machine according to claim 1, characterised in that the outer rotor (6*a*) is made by means of injection moulding techniques.

12. The cylindrical symmetric volumetric machine according to claim 1, characterised in that the cylindrical symmetric volumetric machine (1) is provided with a housing (2), whereby the motor (15) is mounted into the housing (2) or whereby the housing (2) also serves as housing (2) of the motor (15).

13. The cylindrical symmetric volumetric machine according to claim 1, characterised in that a maximal diameter (E) of the motor (15) is maximally twice a maximal diameter (D') of the outer rotor (6*a*).

14. The cylindrical symmetric volumetric machine according to claim 1, characterised in that a maximal diameter (E) of the motor (15) is maximally 1.7 times a maximal diameter (D') of the outer rotor (6*a*).

15. The cylindrical symmetric volumetric machine according to claim 1, characterised in that a maximal diameter (E) of the motor (15) is maximally 1.5 times a maximal diameter (D') of the outer rotor (6*a*).

* * * * *